United States Patent [19]

Molitor

[11] 3,957,326

[45] May 18, 1976

[54] HOT FOOD COUNTER

[75] Inventor: Victor D. Molitor, Denver, Colo.

[73] Assignee: Saga Corporation, Menlo Park, Calif.

[22] Filed: Jan. 3, 1975

[21] Appl. No.: 538,284

[52] U.S. Cl. ..... 312/236; 312/116

[51] Int. Cl.[2] ..... A47F 03/04

[58] Field of Search ..... 312/116, 126, 135, 236, 312/286, 291

[56] References Cited

UNITED STATES PATENTS

| | | | |
|---|---|---|---|
| 2,470,956 | 5/1949 | Savidge et al. | 312/291 |
| 2,964,609 | 12/1960 | Anoff | 312/236 |
| 3,327,092 | 6/1967 | Wilson | 312/236 |
| 3,708,074 | 1/1973 | Fahey | 312/286 |
| 3,719,408 | 3/1973 | Fullington | 312/236 |
| 3,860,306 | 1/1975 | Kenyon | 312/116 |

*Primary Examiner*—Casmir A. Nunberg
*Attorney, Agent, or Firm*—Robert E. Harris

[57] ABSTRACT

A hot food counter is disclosed having a lower heated section for storage of food and an upper heated section for display of food. The upper section is enclosed with food being placed into the upper section by service personnel through sliding doors at the rear wall thereof, while food is withdrawn by customers through a pair of contoured openings in the front wall. The enclosure for the upper section is preferably transparent except for the sliding doors in the rear walls which preferably have mirror finishes, and the tray within the enclosure and upon which food is displayed is preferably inclined downwardly and forwardly, as is the top wall of the enclosure. Heat is circulated through the upper section of the counter by means of small openings at the front of the enclosure through which hot air is injected into the enclosure and circulated therethrough to be expelled at small exhaust openings at the rear of the enclosure, the intake openings being positioned below the openings through which food is withdrawn and being much smaller in size. The openings through which food is withdrawn and the intake and exhaust openings are selected such that the temperature within the enclosure is consistently maintained at a temperature preferably not less than 150°F. and preferably never below 140°F. The lower section of the counter preferably has a separate heater and blower system, and the counter is made portable by mounting the counter on wheels, although portability is not necessary.

11 Claims, 5 Drawing Figures

HOT FOOD COUNTER

FIELD OF THE INVENTION

This invention relates to a hot food counter and more particularly relates to a counter for handling and displaying of hot foods over an extended period of time.

BACKGROUND OF THE INVENTION

It is oftentimes necessary to disply items such as food over an extended period. When such food must be maintained in a heated condition, it is often important that the heat be maintained at a relatively high temperature despite withdrawl of food by customers and replenishment of the food supply by service personnel.

Heretofore it has been necessary either to not have a door or to open a door or the like for customer withdrawl of food and this has let to problems in consistently maintaining the food at an elevated tempature. If not held at an elevated temperature, hot food tends to be less appetizing as the display time increases, and this, of course, can lead to customer complaints and dissatisfaction with the food which could lead to decreased sales.

While prior hot food containers have been suggested and/or utilized, such containers have not proved to be completely satisfactory for use where the food must be maaintained at an elevated temperature over long periods of time.

Among the known prior art, the patent to Levenback, (U.S. Pat. No. 3,545,832) is directed to a hot food counter, but there is no apparent suggestion of the use of a pair of openings at the front of an enclosure through which food can be withdrawn while still maintaining the enclosure temperature at a consistent elevated temperature by means of hot air circulated through the display area of the counter.

The patents to Ladge (U.S. Pat. No. 2,561,517), Hilgers (U.S. Pat. No. 3,120,599), Swift (U.S. Pat. No. 3,162,495), Werner (U.S. Pat. No. 3,170,541), Wilson (U.S. Pat. Nos. 3,327,092 and 3,632,968), Johnson (U.S. Pat. No. 1,800,863), and Molitor (U.S. Pat. Nos. 3,038,986 and 3,478,193) all teach devices that include hot food warmers and/or display counters. None of these patents, however, like the Levenback patent, appear to suggest the use of an enclosure for display of hot foods wherein the front wall of the enclosure has contoured openings and air circulated through the enclosure in such a manner that the temperature is consistently maintained at an elevated temperature.

Other prior art patents for refrigerating displayed food are also known, such as, for example, the patents to Kesling (U.S. Pat. No. 3,172,714), Fullington (U.S. Pat. No. 3,719,408), Monette (U.S. Pat. No. 985,620), Amend (U.S. Pat. No. 1,397,392), Hermann (U.S. Pat. No. 2,243,958), Waldo (U.S. Pat. No. 2,303,098), and Rydin (U.S. Pat. No. 2,608,068). None of these patents, however, appear to teach an enclosure having contoured openings through which food can be withdrawn and are not directed to hot foot service. In addition, while patents in other fields suggest the use of openings to an enclosure [see, for example, the patents to Mikelson (U.S. Pat. No. 2,039,490) and Grieb (U.S. Pat. No. 2,600,240)], there is no suggestion of use in a hot food counter to accomplish the desired end of maintaining an elevated temperature within the enclosure even though food is being withdrawn therefrom.

SUMMARY OF THE INVENTION

This invention provides a hot food counter capable of maintaining food in a hot and appetizing manner over an extended period of time. The counter has contoured openings in the front wall of an enclosed upper section through which food can be withdrawn by a customer without having to open a door or the like. Heat is circulated through the enclosed upper section by means of hot air injected at the front of the enclosure, which air circulates through the enclosed upper section and is then expelled at the rear of the enclosure in a manner such that the elevated temperature within the enclosure is consistently maintained.

It is therefore an object of this invention to provide an improved hot food counter.

It is another object of this invention to provide an improved hot food counter capable of maintaining food in a hot and appetizing manner over extended periods of time.

It is still another object of this invention to provide a hot food counter that has openings therein through which food can be withdrawn by a customer without adversely affecting the temperature within the enclosure to any appreciable degree.

It is still another object of this invention to provide an improved hot food counter having an enclosure with openings at the front through which food can be withdrawn and means for circulating air through the enclosure in a manner such that an elevated temperature is consistently maintained within the enclosure.

It is still another object of this invention to provide an improved hot food counter having an inclined tray upon which food is displayed, which food can be withdrawn through contoured openings at the front of an enclosure enclosing the tray.

It is still another object of this invention to provide an improved hot food counter that is portable and has a lower section for storage of food and an upper section for display of food.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the hereindisclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 3:
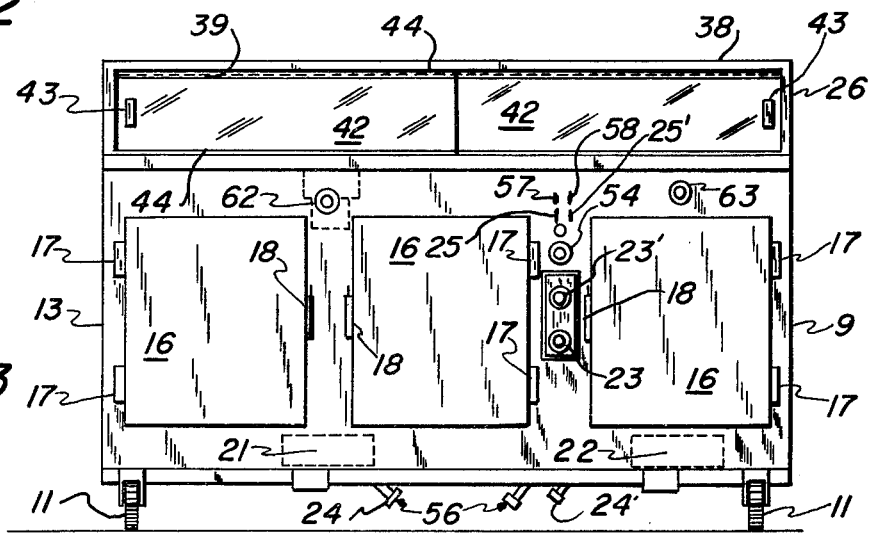
FIG. 3 is a rear view of the hot food counter shown in FIG. 1.
Figure 4:
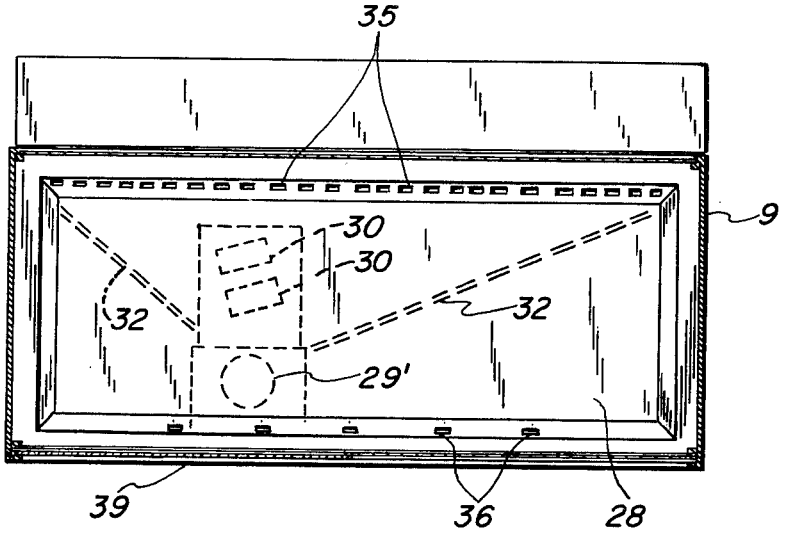
FIG. 4 is a sectional view of the hot food counter taken through lines 4—4 of FIG. 3.
Figure 5:
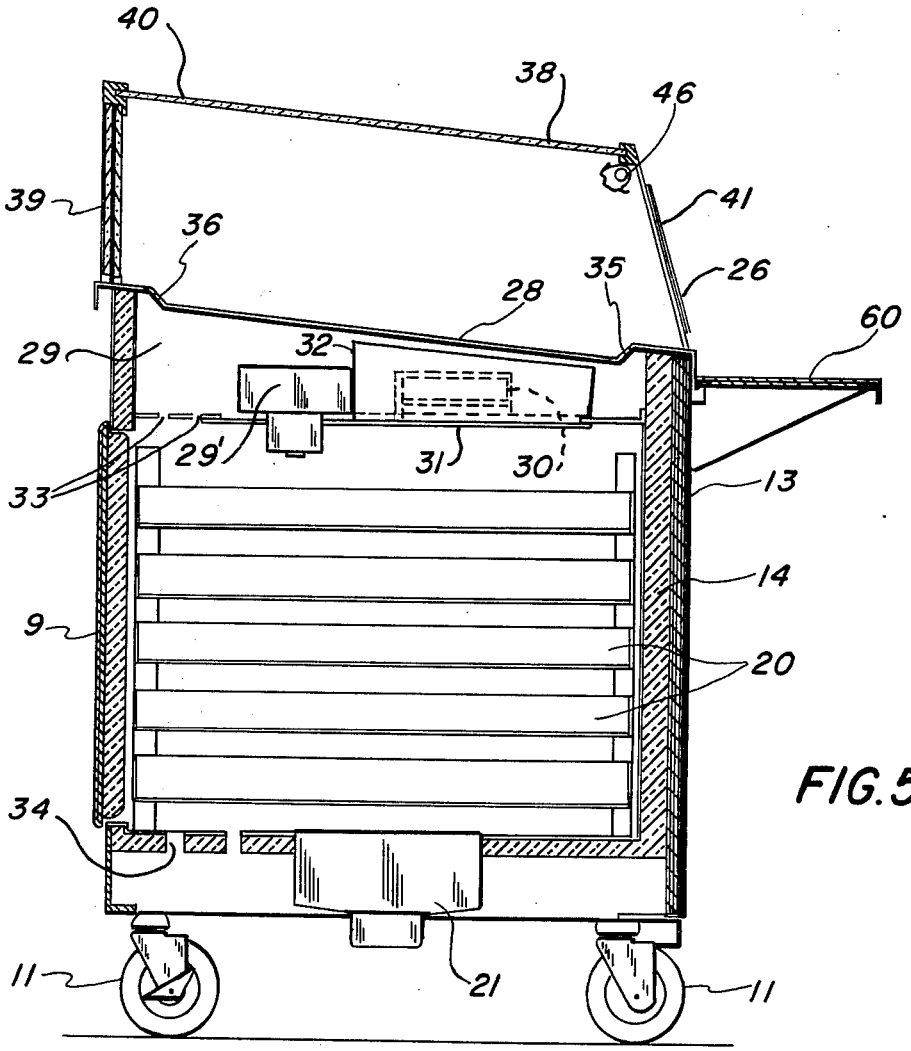
FIG. 5 is a side sectional view taken through the lines 5—5 of FIG. 1.

Referring now to the drawings, the numeral 7 indicates generally the hot food counter of this invention. As shown, the hot food counter preferably includes a body, or housing, structure 9 having wheels 11 at the base thereof (the rear two of which are preferably lockable) so that the counter is movable and can therefore be moved as desired, such as for cleaning and the like. As indicated in FIG. 5, the lower section 13 of the counter is preferably insulated by insulation 14, and, as indicated in FIG. 3, lower section 13 preferably includes doors 16 at the rear thereof through which food may be inserted into and removed from the lower section. As shown in FIG. 3, the doors 16 are conventionally mounted, as by side hinges 17, and the doors are conventionally latched as by latches 18.

The lower section is adapted to retain a plurality of removable baskets 20 in spaced staked relationship, which baskets may be withdrawn from the lower section and the food thereon placed into the upper, or display, section of the counter as is necessary. As also indicated in FIG. 5, blower-heaters 21 and 22 (i.e., blower with heaters within the chamber as is conventional) are provided in conventional manner to provide heat to the lower section. Blower-heaters 21 and 22 are preferably about 1,000 watt and 500 watt heaters, respectively (1,000 watts for double oven and 500 watts for single oven). Blower-heaters 21 and 22 are controlled, as indicated in FIG. 3, by thermostat controls 23 and 23' positioned at the rear of the lower section, or compartment, between two of the doors 16. Electrical power is provided by connecting plugs 24 and 24' to a conventional electrical outlet, using an extension cord (not shown) if necessary, the power being applied through switches 25 and 25'. A 110 volt AC source is utilized with the counter drawing about 30–35 amps overall.

The upper, or display, portion 26 of the counter 7 includes basically an inclined tray, or base, 28 which is inclined downwardly and forwardly so that the food on tray 28 can be better displayed for the convenience of a customer. A middle section 29 of the counter is located between the upper and lower sections and includes a blower 29 and a plurality of heaters 30 (electrical heating elements) with 3 being utilized and the blower being preferably about a 1,000 watt blower. Blower 29 and heaters 30 are mounted on base wall 31 which also serves as the upper wall of the lower compartment 14. Middle section 29 defined by base wall 31 and tray 28 of the upper compartment serves as a plenum chamber to provide hot air for injection into the upper section 26, and heaters 30 heat the underside of tray 28 (which may be insulated if desired). As indicated in the drawings, middle section 29 preferably includes baffles 32 and includes one or more apertures 33 (preferably about one inch in diameter) opening from the middle section 29 to the lower section 13. In addition, one or more apertures 34 are placed in the bottom of the lower section opening at the bottom to the atmosphere.

Baffles 32 direct the air past heaters 30 to heat the same and toward intake openings, or slots, 35 where the air is injected into the upper section of the counter. Exhaust openings, or slots, 36 are provided to exhaust air from the upper section of the counter and return the same to middle section 29. While not meant to be limited thereto, it has been found that 25 spaced intake openings 2 inches long by ¼ inches wide and 5 spaced exhaust openings of like size with respect to the intake openings works well when placed in the shoulder forming the recess in tray 28 as shown in the drawings. This causes the air to be directed across the tray toward food thereon, and, if desired, the shoulder of the tray having the intake openings could be bent to form an acute angle with the top of the tray (an obtuse angle is illustrated for the shoulders having both the intake and exhaust openings therein).

The upper section 26 has an enclosure 38 surrounding tray 28 to maintain the heat therein. As shown, enclosure 38 includes a rear wall 39, a top wall 40, and a front wall 41. Rear wall 39 preferably has a pair of horizontally slidable doors 42 therein each of which doors has an ear 43 at one side thereof to facilitate movement of the doors in the horizontal direction in tracks 44. The purpose of doors 42 is to allow service personnel to replenish food withdrawn from the counter or to stock the counter by opening the normally closed doors. Door 42 could be transparent, but preferably has a mirror finish on the forwardly facing, or inner, side so as to enhance the food display on tray 28.

Figure 1:
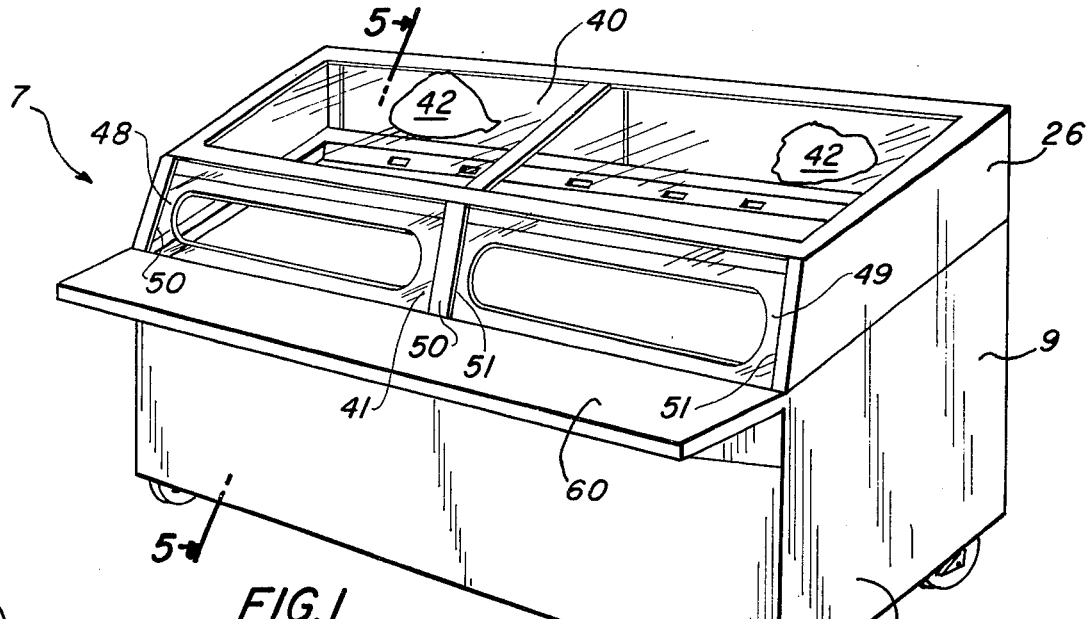
FIG. 1 is a perspective view of the hot food counter of this invention.
Figure 2:
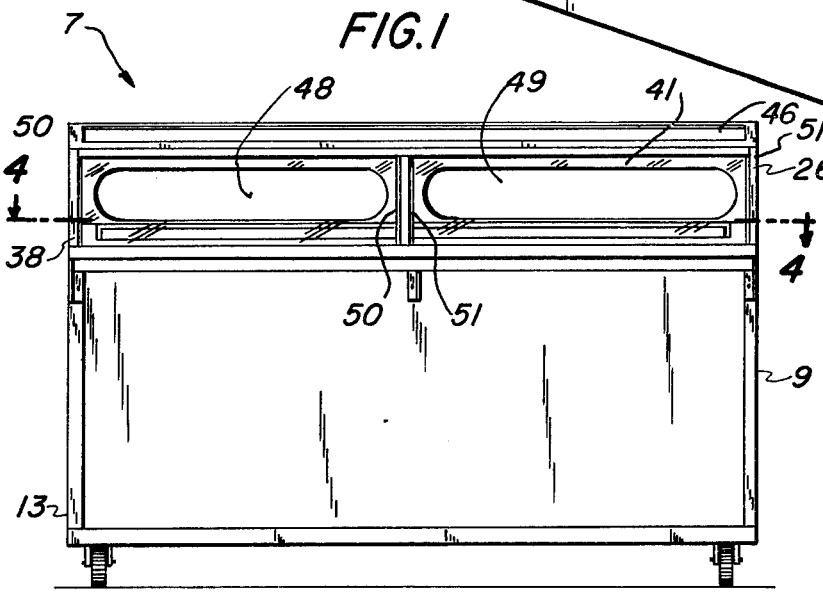
FIG. 2 is a front view of the hot food counter shown in FIG. 1.

Top and front walls 40 and 41 are preferably transparent and both the top and front walls are preferably inclined downwardly, as indicated in FIG. 5, (top wall 40 has about a 3 inch decline preferably). As indicated in FIG. 5, upper section 26 may also include lights 46 at the upper front, if desired. Front wall 41 preferably has a pair of contoured openings 48 and 49 therein that are in side by side relationship and are preferably of oval configuration as indicated in FIG. 2, and the entire front is removable by sliding upwardly in vertical tracks 50 and 51 to remove the front frame as desired. Openings 48 and 49 in front wall 41 are preferably about half as large overall as the entire front wall 41, and must be large enough to allow food to be easily withdrawn by a customer through the openings. It has been found that for a front panel (two are utilized as shown in the drawings) of a size of about 3 feet long by 10¼ inches wide, an oval opening of about 28½ inches long by 4½ inches wide, with the opening being about 2½ inches from the top of the panel and about 3⅛ inches from the bottom of the panel is preferred.

To allow hot air to be injected into enclosure 38 from compartment 29, the series of small openings 35 are provided near the front wall 41 (in the shoulder of tray 28, which shoulder is about one inch deep) so that the hot air is injected into the upper enclosure 38 at the front thereof. The small exhaust openings 36 are located at the rear of the enclosure (also in the shoulder of tray 28), and thus hot air injected through openings 35 at the front of the enclosure is circulated through the enclosure past the food on tray 28 and is thereafter expelled through exhaust openings 36 to be returned to compartment 29.

The five-to-one ratio established between intake and exhaust openings into enclosure 38 and the make-up of middle section 29 causes a positive pressure build-up at all times within enclosure 38. This positive pressure build-up maintains the elevated temperature and keeps air from being taken in through openings 48 and 49 in the front wall. Thus, hot air is injected into the enclosure through the 25 openings at the intake and air is sucked from the enclosure through the 5 openings in the exhaust by the blower in the middle section, the air then being circulated within the middle section.

The openings 48 and 49 in the front wall 41 of the enclosure and the small intake and exhaust openings 35 and 36 are of relative sizes, as brought out hereinabove, such that the heat is maintained substantially constant within enclosure 38 despite the presence of openings 48 and 49 and despite withdrawal of food by a customer from the enclosure. The elevated temperature is preferably no less than about 150°F. and preferably never less than 140°F. (to keep down bacteria) with 155°F being optimum.

Blower 29 and heaters 30 are controlled by means of a third thermostat control 54 at the back of the counter near control switches 23 and 23'. Power to switch 54 is supplied through plug 56 which plugs into a conventional power supply by means, if necessary, of an extension cord (not shown) and switch 57.

A light switch 58 is located adjacent to switch 57. In addition, an arm, or shelf, 60 is also provided at the front of the counter below the openings 48 and 49 in the front wall of the upper section to enable customers to place selected foods thereon after being withdrawn from the tray 28. In addition, recessed thermometers 62 and 63 are also provided to monitor temperatures. The structure of the hot food counter is preferably of stainless steel except for the transparent viewing sections which are preferably plexiglass or glass (top). In addition, the front of the counter is preferably plywood formed with a formica finish in color as desired. While not meant to be limited thereto, a working embodiment about 4 feet in height, about 32 inches in depth (except for shelf 60 which extends 10 inches) and about 6 feet in length has been found to give excellent results.

In operation, the counter is placed in a desired location and tray 28 has food displayed thereon with the hot air being continuously circulated therepast. Lower section 14, may, of course, contain other food for replenishment of the displayed food. As customers select food and withdraw the same through openings 48 or 50 of the counter, more food (generally prepackaged food) can be placed into the counter by service personnel by opening one of the doors 42. To avoid fogging, or condensation, the temperature of newly inserted food should be within 5°–6°F. of the temperature being maintained within the upper, or display, section.

It has been found that the counter of this invention is capable of maintaining an elevated temperature not less than 140°F. and preferably 150°–155°F., and to maintain the food hot and appetizing over an extended display period.

In view of the foregoing, it can be seen that this invention provides an improved hot food counter.

What is claimed is:

1. A hot food counter, comprising: a tray for holding hot food for display; wall means for forming an enclosure with said tray so that displayed hot food on said tray is within said enclosure, said wall means including a front wall having exterior edges and interior edges defining at least one opening in said wall through which displayed food may be withdrawn from said enclosure without moving said front wall; and air heating and circulating means for heating air and circulating said heated air through said enclosure to elevate and maintain the temperature within said enclosure at at least a predetermined minimum elevated value sufficient to maintain displayed food within said enclosure in a hot and appetizing condition over an extended period of time with withdrawal of said displayed food from said enclosure through said opening in said front wall not significantly adversely affecting the elevated temperature within said enclosure.

2. The hot food counter of claim 1 wherein said opening in the front wall is contoured in a generally oval configuration.

3. The hot food counter of claim 1 wherein said front wall includes two openings in side by side relationship.

4. The hot food counter of claim 3 wherein said side by side openings are substantially equal in size.

5. The hot food counter of claim 1 wherein said air heating and circulating means includes a heater and blower positioned outside said enclosure and intake and discharge openings in said tray to inject hot air into said enclosure through said intake openings, said hot air being circulated through said enclosure and expelled from said enclosure through said discharge openings.

6. The hot food counter of claim 5 wherein said intake openings are at the front of said tray and said discharge openings are at the rear of said tray whereby air is circulated through said enclosure from the front to the back thereof.

7. The hot food counter of claim 6 wherein said intake openings are formed in a manner such that hot air passing therethrough is directed toward said tray.

8. The hot food counter of claim 6 wherein said counter includes an air heating section positioned below said tray with a storage compartment below said air heating section, said air heating section including air heating and circulating means for injecting heated air into said enclosure through said intake openings, said air being returned to said air heating section through said discharge openings.

9. A hot food counter, comprising: a housing; a lower section within said housing for storage of hot food therein; an upper section having an inclined tray for receiving thereon hot food to be displayed; means for forming an enclosure with said tray at said upper section including a back wall, a top wall and a front wall, said enclosure enclosing hot food displayed on said tray with said back wall having doors mounted therein for service access to said enclosure, said front and top walls being transparent, and said front wall having a pair of generally oval contoured openings therein positioned in side by side relationship and extending substantially entirely across the front of said opening whereby displayed food can be withdrawn from said enclosure without moving said front wall; air intake openings at the front of said enclosure below said contoured openings in said front wall; air exhaust openings at the rear of said enclosure; and means communicating with said air intake and exhaust openings for injecting hot air into said enclosure through said intake openings so that said hot air is circulated through said enclosure and expelled therefrom through said exhaust openings whereby the temperature within said enclosure is maintained substantially constant at a temperature no less than about 140°F despite withdrawal of displayed food from said enclosure through said openings in said front walls.

10. The hot food counter of claim 9 wherein said intake openings and discharge openings have a five-to-one ratio, respectively, so that a positive pressure is maintained within said enclosure.

11. The hot food counter of claim 9 wherein said contoured openings in said front wall comprise about one-half of the total area of said front wall.

* * * * *

UNITED STATES PATENT AND TRADEMARK OFFICE

CERTIFICATE OF CORRECTION

PATENT NO. : 3,957,326

DATED : May 18, 1976

INVENTOR(S) : Victor D. Molitor

It is certified that error appears in the above-identified patent and that said Letters Patent are hereby corrected as shown below:

Column 1, line 10, delete "disply" and substitute --display--.

Column 1, line 18, delete "let" and substitute --led--.

Column 1, line 19, delete "tempature" and substitute --temperature--.

Column 1, line 29, delete "maaintained" and substitute --maintained--.

Column 3, line 19, delete "staked" and substitute --stacked--.

Column 3, line 45, delete "29" and substitute --29'--.

Column 3, line 46, delete "the" and substitute --each--.

Column 3, line 47, delete "blower" and substitute --heater--.

Column 3, line 47, delete "watt blower" and substitute --watts--.

Column 3, line 48, delete "29" and substitute --29'--.

Column 5, line 11, delete "29" and substitute --29'--.

Column 5, line 38, delete "50" and substitute --49--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*